US006359380B1

(12) United States Patent
Nishizawa et al.

(10) Patent No.: US 6,359,380 B1
(45) Date of Patent: Mar. 19, 2002

(54) COLOR CATHODE RAY TUBE WITH PANEL GLASS HAVING A DIFFERENT LIGHT ABSORPTION CHARACTERISTIC FROM THAT OF AT LEAST ONE OUTER SURFACE LAYER PROVIDED THEREON

(75) Inventors: Masahiro Nishizawa, Mobara; Toshio Tojo; Norikazu Uchiyama, both of Chiba-ken; Maki Ito, Ichihara; Kiyoshi Miura, Mobara; Hidetsugu Matsukiyo, Kawagoe; Tomoji Ohishi; Daigoro Kamoto, both of Hitachi, all of (JP)

(73) Assignees: Hitachi, Ltd.; Hitachi Device Engineering Co., Ltd, both of Tokyo (JP)

( * ) Notice: Subject to any disclaimer, the term of this patent is extended or adjusted under 35 U.S.C. 154(b) by 0 days.

(21) Appl. No.: 09/259,308

(22) Filed: Mar. 1, 1999

(30) Foreign Application Priority Data

Mar. 3, 1998 (JP) ..... 10-050661

(51) Int. Cl.[7] ..... H01J 29/88; H01J 29/28; H01J 29/20

(52) U.S. Cl. ..... 313/479; 313/477 R; 313/478

(58) Field of Search ..... 313/477 R, 478, 313/479, 480, 112, 461; 428/434, 922

(56) References Cited

U.S. PATENT DOCUMENTS 4,728,856 A * 3/1988 Iwasaki et al. ..... 313/467
5,243,255 A * 9/1993 Iwasaki ..... 313/478
5,652,477 A * 7/1997 Tong et al. ..... 313/479
5,660,876 A 8/1997 Kojima et al.
5,681,885 A 10/1997 Kinoshita et al.
5,785,897 A * 7/1998 Toufuku et al. ..... 252/514
6,084,343 A * 7/2000 Van De Poel et al. ..... 313/478
6,143,418 A * 11/2000 Takamiya et al. ..... 428/434

FOREIGN PATENT DOCUMENTS

| | | |
|---|---|---|
| EP | 0 335 680 | 10/1989 |
| EP | 0 585 819 A1 | 3/1994 |
| EP | 0 590 740 A2 | 4/1994 |
| GB | 2 250 133 A | 5/1992 |
| JP | 1-311546 | 12/1989 |
| JP | 5-107403 | 4/1993 |
| WO | WO 94/19709 | 9/1994 |

* cited by examiner

*Primary Examiner*—Ashok Patel
*Assistant Examiner*—Karabi Guharay
(74) *Attorney, Agent, or Firm*—Antonelli, Terry, Stout & Kraus, LLP

(57) ABSTRACT

In a color cathode ray tube having a vacuum vessel that comprises a panel, a neck for housing an electron gun therein, and a funnel for connecting the panel and the neck, in which the inner surface of the panel glass is coated with a phosphor layer in different colors to give a display screen; the panel glass contains ions capable of selectively absorbing light within the range of visible rays, and its outer surface is coated with an electric conductive surface film.

18 Claims, 7 Drawing Sheets

COLOR CATHODE RAY TUBE WITH PANEL GLASS HAVING A DIFFERENT LIGHT ABSORPTION CHARACTERISTIC FROM THAT OF AT LEAST ONE OUTER SURFACE LAYER PROVIDED THEREON

BACKGROUND OF THE INVENTION

1. Field of the Invention

The present invention relates to a color cathode ray tube, in particular, to that having anti-reflective and antistatic properties and capable of realizing high-contrast image display.

2. Description of the Related Art

Color cathode ray tubes to be used as color TV picture tubes or monitor tubes for information appliances and others have a vacuum vessel that comprises a panel, a neck for housing an electron gun therein, and a funnel for connecting the panel and the neck, in which the inner surface of the panel is coated with a phosphor layer in different colors to give a display screen, and plural (generally, three) electron beams as emitted by the electron gun housed in the neck are modulated according to image signals and impinge on the individual phosphors of different colors (generally, three colors) that constitute the phosphor layer to reproduce images.

FIG. 6 is a schematic sectional view showing an outline of the structure of a shadow mask-type color cathode ray tube, which is one example of color cathode ray tubes of that type. In FIG. 6, the reference numeral 1 indicates a panel, 2 indicates a neck, 3 indicates a funnel, 4 indicates a phosphor layer, 5 indicates a shadow mask, 6 indicates a mask frame, 7 indicates a shadow mask support mechanism, 8 indicates a support pin, 9 indicates a magnetic shield, 10 indicates an anode button, 11 indicates an internal electric conductive coating, 12 indicates a deflector, 13 indicates an electron gun, and 14 indicates three electron beams (red, green, blue).

In the color cathode ray tube of FIG. 6, the panel 1 to form a screen, the neck 2 for housing an electron gun therein, and the funnel 3 to connect the panel and the neck constitute a vacuum vessel. The inner surface of the vacuum vessel is coated with the internal electric conductive coating 11 via which the high cathode voltage as applied to the anode button 5 is transmitted to the inner surface of the screen and to the electron gun. The shadow mask 5 is welded to the mask frame 6, and is suspended between the support pins 8 that are embedded in the inner wall of the skirt portion of the panel 1, via the shadow mask support mechanism 7 therebetween. This is kept opposed to the phosphor layer 4 as formed on the inner surface of the panel 1, while being spaced from the phosphor layer 4 at a predetermined interval therebetween. The magnetic shield 9 is to shield the electron beams 14 from the external magnetic field of, for example, terrestrial magnetism, and this is kept welded to the mask frame 6.

The deflector 12 is mounted on the funnel in the position adjacent to the neck, by which are formed a horizontal magnetic field and a vertical magnetic field around the flow of the electron beams being emitted by the electron gun. In that condition, three electron beams as emitted by the electron gun 13 are deflected in two directions of a horizontal direction and a vertical direction, thereby to scan the phosphor layer 4 in the two-dimensional direction.

The cathode ray tube of that type is provided with an anti-reflective and antistatic film (film for surface treatment, hereinafter referred to as "surface film") which is for preventing the ambient light that enters the screen of the panel from reflecting to lower the contrast of the display image formed, and for preventing the panel from being electrostatically charged by the static electricity to be caused by the electron beam scanning.

FIG. 7 is to show one example of the anti-reflective structure for ambient light in the color cathode ray tube illustrated above. FIG. 7 is a schematic sectional view showing the portion A of FIG. 6 on an enlarged scale. In FIG. 7, the reference numeral 42 indicates a black matrix for partitioning the phosphor layer into plural color phosphors 43, thereby preventing color mixing so as to improve the contrast of the display image formed; 43 indicates three phosphors of red, green and blue; 44 indicates a metal back for generating a screen potential; 51 indicates an electron beam passing opening; R, G and B indicate electron beams of red, green and blue, respectively; 20 indicates an anti-reflective and antistatic film; 23 indicates the light emitted by the phosphor; 24 indicates ambient light; and 25 and 26 indicate reflected light from the ambient light 24. The other reference numerals that are the same as those in FIG. 6 correspond to those in FIG. 6.

As in FIG. 7, three electron beams R, G and B emitted by the electron gun are selected in color, while passing through the electron beam passing openings 51 of the shadow mask 5, and impinge on the individual phosphors 43. With the electron beams impinging thereon, the phosphors 43 are excited and emit light, and the emitted light runs outside through the panel 1 (toward the viewer looking at the display image). On the outer surface of the panel 1, formed is the anti-reflective and antistatic film 20. The anti-reflective and antistatic film 20 is composed of two layers, of which the first layer 20*a* is of a thin electric conductive film with high refractivity (having a refractive index of about 2), and the second layer 20*b* is of a thin, irregular reflective film having a lower refractive index (1.47) than the layer 20*a*.

Of the ambient light 24 to enter the panel 1, the light 25 having penetrated into the anti-reflective and antistatic film 20 is absorbed by or interfered with the film 20, whereby its energy is attenuated, resulting in that the intensity of harmful reflected light that may degrade the display image formed could be lowered. In addition, the ambient light 24 reflects irregularly on the outer surface of the panel to give irregularly-reflected light 26, whereby the harmful reflection that may degrade the display image is retarded. The first layer 20*a* of an electric conductive film is connected with the earth outside the effective display region. The static electricity generated on the outer surface of the panel 1 flows to the earth via the first layer 20*a*, whereby the screen is prevented from being electrostatically charged.

In general, the anti-reflective and antistatic film 20 of that type is formed on the outer surface of the panel according to a so-called sol-gel method.

Concretely, the film 20 may be formed according to any of the following methods:

(1) A mixture composition capable of forming a layer with high refractivity, which is prepared by dispersing fine grains (having a grain size of at most tens nm) of an electric conductive oxide (e.g., ATO (antimony-doped tin oxide) or ITO (tin-doped indium oxide)) in an alcoholic solution, is applied onto glass for the panel 1 through so-called spin-coating to form a lower layer of an even film having a uniform thickness of from about 60 to about 100 nm, and a hydrolytic solution of a silicon alkoxide compound is applied thereover through spin-coating or spray-coating to form an upper layer of an even film having a uniform thickness of from about 80 nm to about 130 nm, thereby completing the formation of a two-layered, anti-reflective and antistatic film of those lower and upper layers on the glass.

(2) An antimony-doped, organic or inorganic tin compound is applied onto glass for the panel 1 through CVD (chemical vapor deposition) or LVD (liquid vapor deposition) to form an ATO film on the glass, and thereafter a hydrolytic solution of a silicon alkoxide compound is uniformly applied thereover to form a two-layered film having a uniform thickness of from about 80 nm to about 100 nm. In addition, for the purpose of reducing the reflected color density of the two-layered, anti-reflective and antistatic film and for reducing the reflectance thereof for visible rays falling within a wavelength range of from 380 nm to 780 nm, a hydrolytic solution of a silicon alkoxide compound is further sprayed over the two-layered film to form a third layer of a light-scattering film having a thickness of from about 10 nm to about 50 nm, and the surface of the third layer is roughened.

For example, Japanese Patent Laid-Open 4-334853 and Japanese Patent Laid-Open 5-343008 disclose the related arts as above.

Apart from the related arts (1) and (2), known is another related art to be mentioned below.

This is directed to a color cathode ray tube with antistatic and anti-reflective properties of increasing the contrast of images formed while preventing the brightness of the phosphors therein from lowering. For this, a first layer of a film having selective light absorbant and antistatic capabilities is formed on the outer surface of the panel by applying a coating liquid that contains a coloring material of, for example, dye, pigment and the like onto the outer surface of the panel, and thereafter another coating liquid containing an alkyl silicate compound in a solid phase is applied over the first layer to form thereon a second layer. In this related art, the first layer formed acts for selective light absorption and for prevention of static electrification, and the difference in the refractivity between the first layer and the second layer brings about the anti-reflective effect.

For the details of the related art of this type, for example, referred to are the disclosures of Japanese Patent Laid-Open 4-17242, Japanese Patent Laid-Open 4-137342, Japanese Patent Laid-Open 5-203804.

In addition to the above, further known is a method of coloring a panel with no anti-reflective and anti-static film formed on its outer surface, in which, however, the panel could not exhibit an anti-reflective and antistatic effect.

For the panel having selective light absorbability and coated, on its outer surface, with a surface film having anti-reflective and antistatic capabilities, the surface film shall be formed in a coating method for forming a thin film on the surface of glass for the panel. In this method, if the selective light absorbability of the panel is increased, the brightness of the phosphor screen is lowered and the phosphor screen is unfavorably colored, thereby resulting in that the screen shall have a chromatic body color to degrade the quality of the color display image formed. For these reasons, the method is problematic.

On the other hand, the technique of adding a coloring material such as pigment or dye to the transparent electric conductive layer (first layer, or lower layer) for the multi-layered film is also problematic in that the electroconductivity of the film is thereby lowered to degrade the antistatic capabilities of the film. Another problem in this is that the refractive index of the first layer is varied to degrade the anti-reflective capabilities of the film.

SUMMARY OF THE INVENTION

An object of the invention is to solve the problems with the related arts noted above, and to provide a color cathode ray tube having good anti-reflective and antistatic properties and capable of realizing high-quality image display.

In the color cathode ray tube of the invention that attains the object, the selective light absorbing capabilities of the screen are realized by a specific constituent material for panel glass and by a specific, multi-layered, surface film formed on the panel glass through coating. In the color cathode ray tube of the invention, the glass material for the panel contains a selective light absorbant additive of, for example, neodymium, neodymium oxide, erbium, erbium oxide and the like, in an amount of about 0.005% to about 1% by weight. Ions of neodymium, neodymium oxide, erbium, erbium oxide and others to be in the glass for the panel of the color cathode ray tube of the invention have selective light absorbing capabilities. Therefore, in the invention, the amount of the light absorbant material to be in the surface film on the outer surface of the panel glass is reduced. With that constitution, the body color of the screen of the color cathode ray tube of the invention is attenuated, and the antistatic property of the tube is prevented from being degraded. As a result, the color cathode ray tube of the invention has good anti-reflective and antistatic capabilities to give high-contrast display images.

Specifically, (1) the color cathode ray tube of the invention has a vacuum vessel comprising a panel, a neck for housing an electron gun therein, and a funnel for connecting the panel and the neck, in which the inner surface of the panel is coated with a phosphor layer in different colors to give a display screen, and the panel glass contains ions with selective light absorbability for visible rays (covering a wavelength range of from 380 nm to 780 nm) and is coated, on its outer surface, with a selective light absorbent surface film having low sheet resistivity and low reflectance.

The terminology, selective light absorption, as referred to herein for the panel glass or the surface film is meant to indicate that the spectral absorption pattern of the panel glass or the surface film gives an absorption maximum that can be differentiated from the base line in at least one or more specific wavelength ranges. This means that the white light having entered the panel glass or the surface film is selectively absorbed by the glass or the film, and runs out of it as chromatic transmitted light.

(2) For the color cathode ray tube of the invention, the panel glass as characterized by (1) contains any one or both of neodymium oxide and erbium oxide to have selective light absorbability in the visible ray region noted above.

(3) In the color cathode ray tube of the invention, the surface film as characterized by (1) is an anti-reflective and antistatic film having at least one layer.

(4) In the color cathode ray tube of the invention, the anti-reflective and antistatic film as characterized by (3) has a layer containing a dye.

(5) For the color cathode ray tube of the invention, light to be transmitted by the panel glass as characterized by (2) gives x of from 0.280 to 0.290 and y of from 0.285 to 0.305 in the CIE chromaticity diagram.

The substance to be added to the panel glass so as to make the panel glass have selective light absorbability for visible rays is not limited to neodymium oxide or erbium oxide mentioned above, but includes any other substances and ions having the ability of selective light absorption that is comparable to that of those oxides. Such other substances and ions include, for example, rare earth elements such as samarium, europium, praseodymium; rare earth ions such as samarium ion, europium ion, praseodymium ion; oxides of rare earth elements such as samarium, europium, praseodymium; ions of the oxides.

As mentioned hereinabove, the invention provides a high-quality color cathode ray tube which has selective light absorbing capabilities owing to the specific panel glass as combined with the specific surface film formed on the panel glass, and therefore realizes high-contrast image display. Owing to that combination, in addition, the color cathode ray tube of the invention has good antistatic capabilities and good anti-reflecting capabilities with the body color of the panel screen being attenuated.

BRIEF DESCRIPTION OF THE INVENTION

DETAILED DESCRIPTION OF THE PREFERRED EMBODIMENTS

Figure 1:
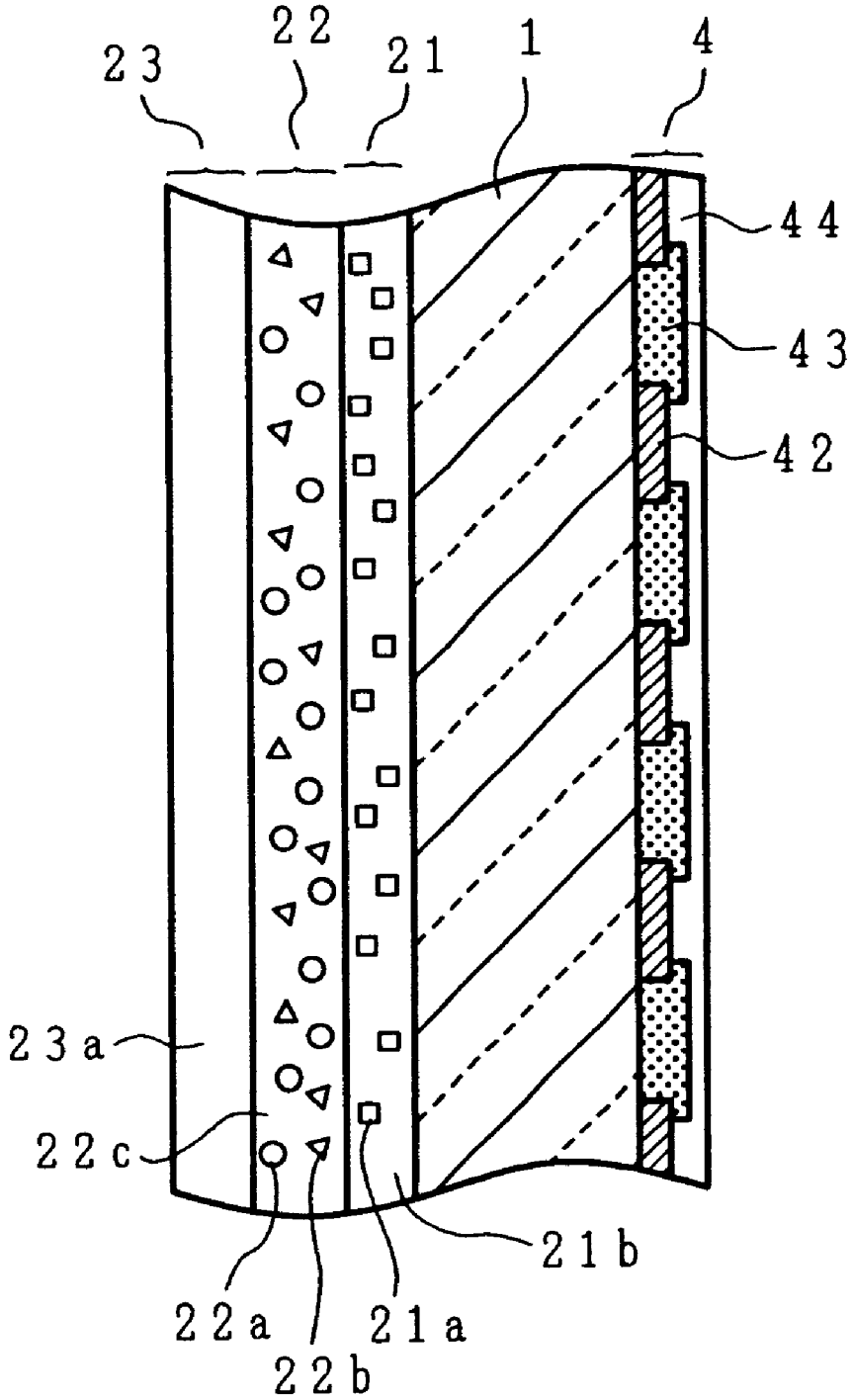
FIG. 1 is a schematic sectional view showing the principal structure of the panel of the color cathode ray tube as produced in Example 1 of the invention.

Embodiments of the invention are described in detail with reference to the following Examples, which, however, are not intended to restrict the scope of the invention.

EXAMPLE 1

Glass for the panel of the color cathode ray tube of this Example is prepared by adding from 0.005% to 1% by weight of neodymium oxide to a conventional panel glass paste. The neodymium content of the panel glass is measured by the use of an ICP (inductive coupled plasma) analyzer in which the panel glass is dissolved in hydrofluoric acid. The panel glass is coated with a three-layered surface film having the composition 1 mentioned below. Except for the step of coating the panel glass with the surface film as specifically indicated herein, the color cathode ray tube of this Example is constructed according to a conventional method.

Composition 1

| | |
|---|---|
| Coating liquid for forming the first layer (Liquid A): | |
| Silicon ethoxide | 1 wt. % |
| Yellow pigment (disazo yellow) | 0.1 wt. % |
| Nitric acid | 0.01 wt. % |
| Pure water | 20 wt. % |
| Dispersant (polyoxyethylene nonylphenyl ether) | 0.02 wt. % |
| Ethanol | balance |
| Coating liquid for forming the second layer liquid B) | |
| Fine silver grains | 0.1 wt. % |
| Fine palladium grains | 0.2 wt. % |
| Pure water | 40 wt. % |
| High-boiling-point solvent (ethylene glycol isopropyl ether | 10 wt. % |
| Ethanol | balance |
| Coating liquid for forming the third layer (liquid C): | |
| Silicon ethoxide | 0.7 wt. % |
| Pure water | 10 wt. % |
| High-boiling-point solvent (ethylene glycol monoethyl ether) | 10 wt. % |
| Ethanol | balance |

The fine silver grains have a grain size of about 5 nm; and the fine palladium grains have a grain size of about 5 nm. The grain size as referred to herein indicates the mean grain size of the grains as measured by the use of a Coulter's grain size meter of Model N. For their grain size, the pigment grains and the fine electric conductive grains may well be so small that they cause no scattering of visible rays (falling within a wavelength range of from 380 nm to 780 nm) thereon. Concretely, the grains shall have a grain size smaller than ⅙ of the shortest wavelength of visible rays.

The surface of the panel glass with neodymium oxide added thereto is polished, then the abrasive used is removed, and the surface of the panel glass thus polished is cleaned by showering it with city water or pure water. Next, the panel glass is kept at about 60° C. at its surface, and then sprayed with the liquid A. For the spray coating, for example, used is a Binks' spray-coater of Type A with two flow nozzles.

Next, the panel glass is kept at about 40° C. at its surface, then coated with the liquid B according to a spin-coating method using a spinner, and thereafter dried at a temperature falling between 40° C. and 60° C. After having been thus dried, the panel glass is again controlled at about 40° C. at its surface, and then coated with the liquid C according to a spin-coating method. After this, the thus coated panel glass is baked under heat at 160° C.

Figure 7:
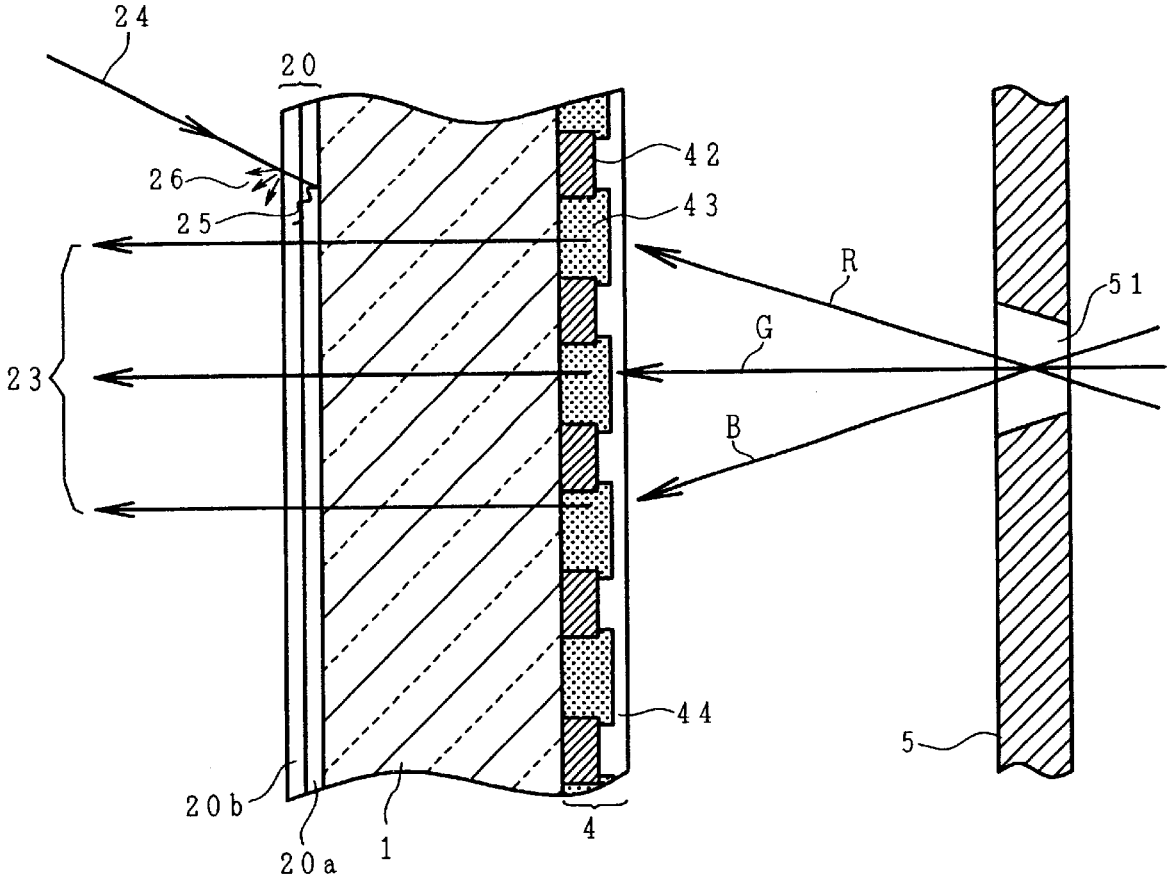
FIG. 7 (PRIOR ART)
FIG. 7 is a schematic sectional view of the portion A of FIG. 6, as drawn on an enlarged scale, and this is to show one example of the anti-reflective structure for ambient light in the color cathode ray tube illustrated.

FIG. 1 is a schematic sectional view showing the principal structure of the panel of the color cathode ray tube as produced in Example 1 of the invention. Like in FIG. 7, the panel glass 1 in FIG. 1 has, on its inner surface, phosphors 43 of three colors of R, G and B as partitioned via black matrices 42 each existing between them, and has a metal back 44 of aluminum as formed thereover through sputtering.

The surface film as formed on the outer surface of the panel glass 1 is composed of three layers. The first layer (lower layer) 21 of the surface film comprises yellow pigment 21*a* and silica 21*b*, and has a thickness of about 50 nm. The second layer (interlayer) 22 of the suface film comprises fine silver grains 22*a*, fine palladium grains 22*b*, and silica 22*c* having been infiltrated thereinto from the third layer (upper layer) 23 and acting therein as a binder, and has a thickness of about 25 nm. The third layer 23 of the surface film is silica 23*a*, and has a thickness of about 70 nm. The thickness of each layer is measured through scanning electron microscopy (SEM) at its cross section image.

Figure 2:
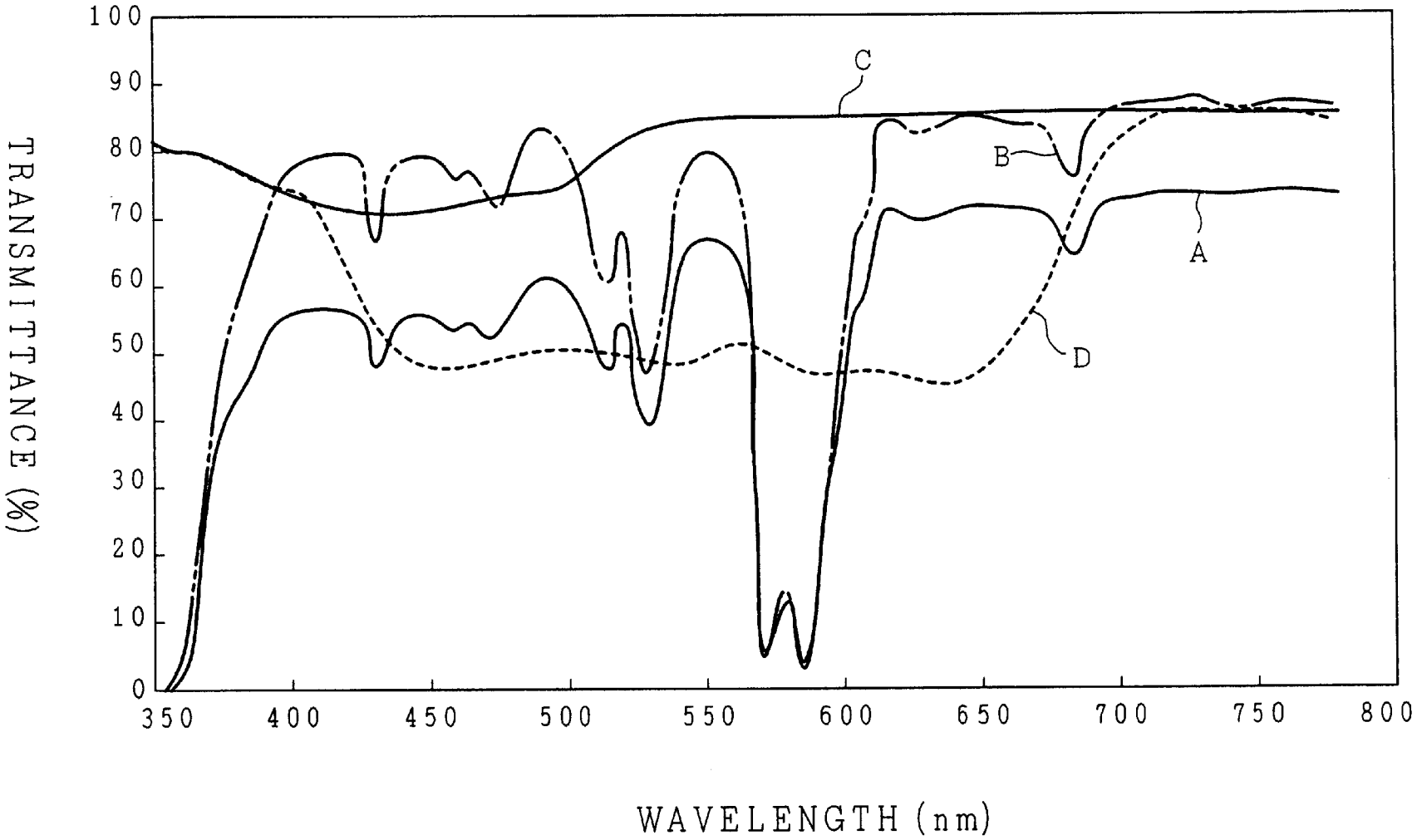
FIG. 2 is a graph showing the transmittance of the non-coated glass for the panel in Example 1, the transmittance of the surface film itself as formed on the panel glass, and the total transmittance of the panel coated with the surface film, in which is shown the transmittance of a conventional tint panel for reference.

FIG. 2 is a graph showing the transmittance of the non-coated glass for the panel in Example 1, the transmittance of the surface film itself as formed on the panel glass, and the total transmittance of the panel screen coated with the surface film, in which is shown the transmittance of a conventional tint panel for reference. In FIG. 2, the abscissa indicates the wavelength (nm) and the ordinate indicates the transmittance (%). To measure the transmission spectra as in FIG. 2, the phosphors 43, the metal back 44 and the black matrices 42 having been formed on the inner surface of the panel glass are removed, and the resulting sample is subjected to visible-ray spectrometry.

In FIG. 2, the curve A indicates the total transmittance of the panel coated with the surface film, the curve B indicates the transmittance of the non-coated panel glass, the curve C indicates the transmittance of the surface film itself, and the curve D indicates the transmittance of the reference sample of a conventional tint panel. As illustrated in FIG. 2, the curve A for the panel coated with the surface film of this Example indicates selective light absorption in the wavelength range of from 500 nm to 550 nm and in the wavelength range of from 550 nm to 600 nm. Also as illustrated therein, the selective light absorption of the non-coated panel glass is more significant than the light absorption of the surface film itself. The reflectance for eye photopic responsibility of the surface film in the Example is about 0.8%, and the sheet resistivity thereof is 2000 $\Omega/cm^2$. The reflectance for eye photopic responsibility (RV) as referred to herein is obtained from the reflectance $R(\lambda)$ in a range of the wavelength ($\lambda$) of from 380 nm to 780 nm and the relative visibility $V(\lambda)$ in that range of the wavelength ($\lambda$) of from 380 nm to 780 nm, according to the following equation:

$$RV=(\int R(\lambda)V(\lambda)d\lambda)/\int V(\lambda)d\lambda$$

The sheet resistivity is measure by the use of Dia Instrument's Loresta IP type.

The color cathode ray tube of this Example was tested, according to known test methods, for the reflectance of the phosphor screen (from which is excluded the surface reflectance of the surface film), the brightness of the phosphor screen, the contrast of the display image formed, and the chromaticity of the body color of the screen. The reflectance of the phosphor screen of the color cathode ray tube of this Example is about 5% lower than that of a conventional color cathode ray tube; the brightness of the phosphor screen of the former is about 10% higher than that of the latter; and the image contrast in the former is about 15% higher than that in the latter. For the body color of the screen as designated according to JIS Z 8729 for "color specification of body color in color systems of L'ab' and L'u'v'", a'=0.5 and b'=−0.5.

In this Example, the sheet resistivity of the surface film could be changed by varying the amount of fine silver grains and that of fine palladium grains in the liquid B. For example, where the amount of fine silver grains in the liquid B is 0.2% by weight and that of fine palladium grains therein is 0.3% by weight, the sheet resistivity of the surface film formed is 50 $\Omega/cm^2$.

In this Example, where the thickness of the first layer falls between 30 nm and 80 nm, that of the second layer falls between 45 nm and 100 nm and that of the third layer falls between 45 nm and 100 nm, the same results as above could be obtained.

EXAMPLE 2

In this Example, neodymium oxide and erbium oxide are added to a conventional panel glass paste to prepare panel glass having a transmittance for eye photopic responsibility of about 60%. The panel glass is coated with a two-layered surface film having the composition 2 mentioned below. The neodymium oxide content of the panel glass and the erbium oxide content thereof are measured by the use of ICP (inductive coupled plasma) analyzer in which the panel glass is dissolved in hydrofluoric acid. Except for the step of coating the panel glass with the surface film as specifically indicated herein, the color cathode ray tube of this Example is constructed according to a conventional method.

The transmittance for eye photopic responsibility (TV) as referred to herein is obtained from the transmittance $T(\lambda)$ in a range of the wavelength ($\lambda$) of from 380 nm to 780 nm and the relative visibility $V(\lambda)$ in that range of the wavelength ($\lambda$) of from 380 nm to 780 nm, according to the following equation:

$$TV=(\int T(\lambda)V(\lambda)d\lambda)/\int V(\lambda)d\lambda$$

Composition 2:

| | |
|---|---|
| Coating liquid for forming the first layer liquid D): | |
| Fine silver grains | 0.2 wt. % |
| Fine palladium grains | 0.2 wt. % |
| Red pigment (quinoacridine type) | 0.1 wt. % |
| Blue pigment (phthalocyanine type) | 0.05 wt. % |
| Yellow pigment (disazo yellow) | 0.05 wt. % |
| Pure water | 45 wt. % |
| High-boiling-point solvent (ethylene glycol isopropyl ether) | 15 wt. % |
| Ethanol | balance |
| Coating liquid for forming the second layer (liquid E): | |
| Silicon ethoxide | 0.7 wt. % |
| Pure water | 10 wt. % |
| High-boiling-point solvent (ethylene glycol monoethyl ether) | 10 wt. % |
| Ethanol | balance |

The fine silver grains have a grain size of about 5 nm; and the fine palladium grains have a grain size of about 5 nm. The grain size is measured in the same manner as in Example 1. The surface of the panel glass with neodymium oxide and erbium oxide added thereto is polished, then the abrasive used is removed, and the surface of the panel glass thus polished is cleaned by showering it with city water or pure water. Next, the panel glass is kept at about 60° C. at its surface, and then coated with the liquid D according to a spin-coating method.

Next, the panel glass is kept at a temperature falling between about 40° C. and about 60° C. at its surface, and dried. After having been thus dried, the panel glass is again controlled at about 40° C. at its surface, and then coated with the liquid E according to a spin-coating method. After this, the thus-coated panel glass is baked under heat at 160° C.

Figure 3:
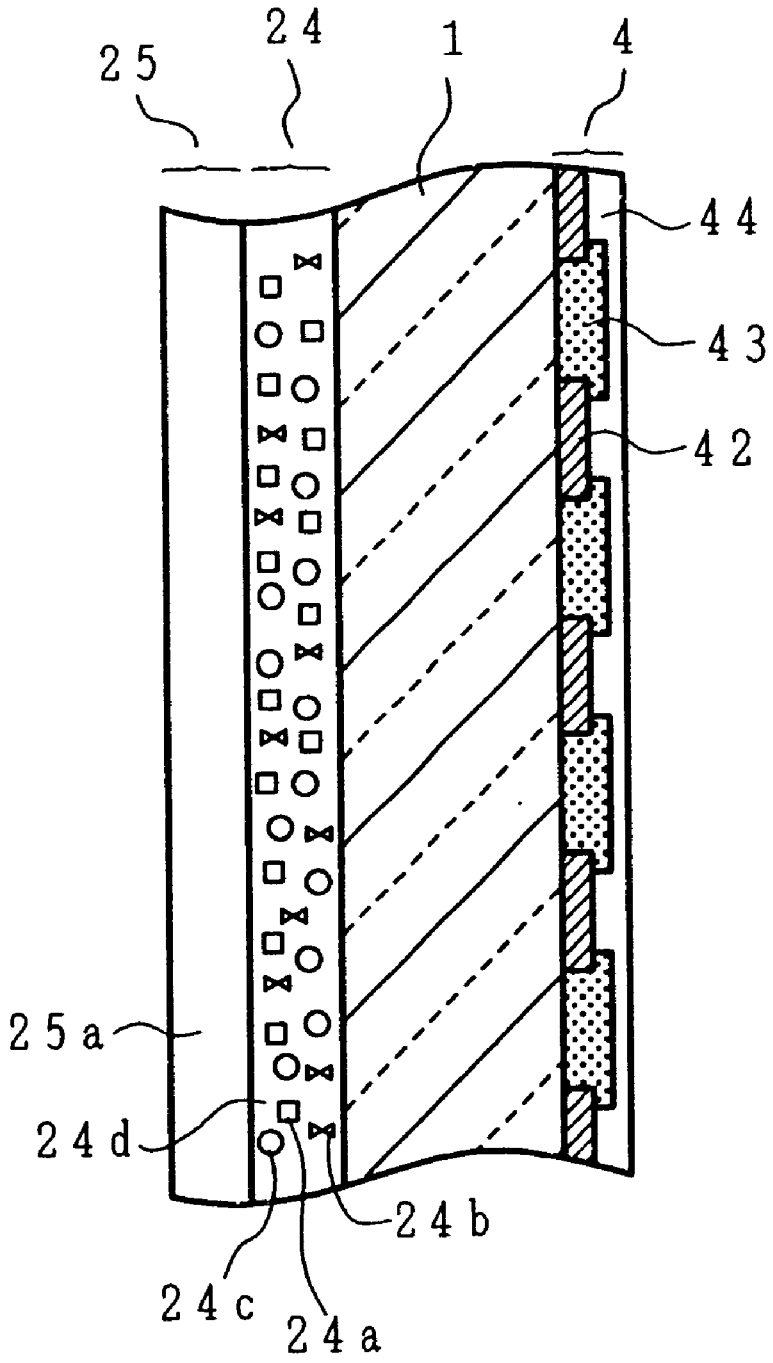
FIG. 3 is a schematic sectional view showing the principal structure of the panel of the color cathode ray tube as produced in Example 2 of the invention.

FIG. 3 is a schematic sectional view showing the principal structure of the panel of the color cathode ray tube as produced in Example 2 of the invention. Like in FIG. 1, the panel glass 1 in FIG. 3 has, on its inner surface, phosphors 43 of three colors of R, G and B as partitioned via black matrices 42 each existing between them, and has a metal back 44 of aluminum as formed thereover through sputtering.

The surface film as formed on the outer surface of the panel glass 1 in this Example is composed of two layers. The first layer (lower layer) 24 of the surface film comprises yellow pigment 24*a*, red pigment 24*b*, fine silver grains 24*c*, fine palladium grains 24*d*, and silica 24*e* having been infiltrated thereinto from the second layer (upper layer) 25, and has a thickness of about 80 nm. The second layer (upper layer) 25 of the surface film is of silica 25*a*, and has a thickness of about 70 nm. The thickness of each layer is measured from the SEM image in its cross section, in the same manner as in Example 1.

Figure 4:
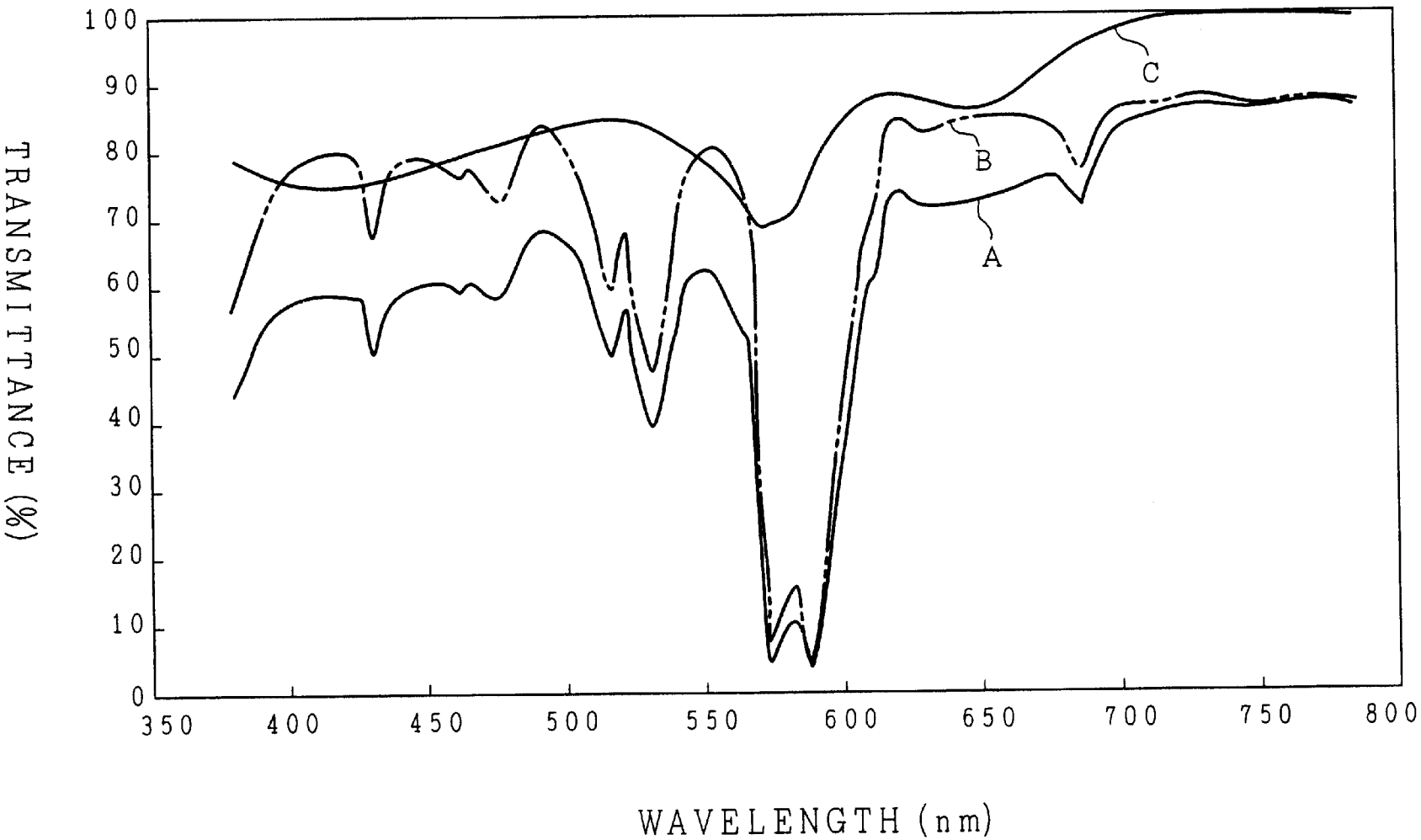
FIG. 4 is a graph showing the transmittance of the non-coated glass for the panel in Example 2, the transmittance of the surface film itself as formed on the panel glass, and the total transmittance of the panel coated with the surface film.

FIG. 4 is a graph showing the transmittance of the non-coated glass for the panel in Example 2, the transmittance of the surface film itself as formed on the panel glass, and the total transmittance of the panel screen coated with the surface film. In FIG. 4, the abscissa indicates the wavelength (nm) and the ordinate indicates the transmittance (%). In this, the curve A indicates the total transmittance of the panel coated with the surface film, the curve B indicates the transmittance of the non-coated panel glass, and the curve C indicates the transmittance of the surface film itself. The transmittance spectra in FIG. 4 are measured in the same manner as in Example 1.

As illustrated in FIG. 4, the curve A for the panel coated with the surface film of this Example indicates selective light absorption in the wavelength range of from 500 nm to 550 nm and in the wavelength range of from 550 nm to 600 nm. Also as illustrated therein, the selective light absorption of the non-coated panel glass is more significant than the light absorption of the surface film itself. The reflectance for eye photopic responsibility of the surface film in this Example is about 0.7%, and the sheet resistivity thereof is 4000 $\Omega/cm^2$. These data are measured in the same manner as in Example 1.

The color cathode ray tube of this Example was tested, according to known test methods, for the reflectance of the phosphor screen (from which is excluded the surface reflectance of the surface film), the brightness of the phosphor screen, the contrast of the display image formed, and the chromaticity of the body color of the screen. The reflectance of the phosphor screen of the color cathode ray tube of this Example is about 10% lower than that of a conventional color cathode ray tube; the brightness of the phosphor screen of the former is about 10% higher than that of the latter; and the image contrast in the former is about 20% higher than that in the latter. For the body color of the screen as designated according to JIS Z 8729 for "color specification of body color in color systems of L'a'b' and L'u'v" in the same manner as in Example 1, a'=1.0 and b'=−3.5. The data support good appearance of the screen.

In this Example, where the thickness of the first layer falls between 50 nm and 100 nm and that of the second layer falls between 40 nm and 90 nm, the same results as above could be obtained.

EXAMPLE 3

In this Example, prepared is panel glass by adding from 0.005 to 1% by weight of neodymium oxide to a conventional panel glass paste. The panel glass is coated with a three-layered surface film having the composition 3 mentioned below. Except for the step of coating the panel glass with the surface film as specifically indicated herein, the color cathode ray tube of this Example is constructed according to a conventional method.

Composition 3:

| Coating liquid for forming the first layer (liquid F): | |
|---|---|
| Ethoxysilane | 1.2 wt. % |
| Yellow pigment (disazo yellow) | 0.2 wt. % |
| Fine grains of ATO (antimony-doped tin oxide) | 0.2 wt. % |

-continued

| Coating liquid for forming the first layer (liquid F): | |
|---|---|
| Nitric acid (67% solution) | 0.01 wt. % |
| Pure water | 30 wt. % |
| Ethanol | balance |

Coating liquid for forming the second layer (Liquid B).

Coating liquid for forming the second layer (Liquid C).

The surface of the panel glass with neodymium oxide added thereto is polished, then the abrasive used is removed, and the surface of the panel glass thus polished is cleaned by showering it with city water or pure water. Next, the panel glass is kept at about 60° C. at its surface, and then sprayed with the liquid F. For the spray coating, used is a Binks' spray-coater of Type A with two flow nozzles (flow rate:1.5 liters/hr, aeration:200 liters/min), and the surface of the panel glass is spaced by 180 mm from the spray-coater. The spray coating is repeated twice.

After having been coated with the liquid F, the panel glass is further coated with the liquid B and the liquid C in that order according to a spin-coating method. Concretely, the panel glass is kept at about 60° C. at its surface, and coated with the liquid B by the use of a spin coater. For this, 40 ml of the liquid B is injected into the spin coater, and the panel glass is coated with it while being spun at 150 rpm over a period of 5 seconds. After thus coated, the panel glass is dried at about 25° C. Next, this is further coated with the liquid C by the use of a spin coater into which 40 ml of the liquid C is injected, while being spun at 150 rpm over a period of 5 seconds. After this, the thus-coated panel glass is baked at about 160° C. for 30 minutes.

The fine grains of ATO (antimony-doped tin oxide) used herein have a mean grain size of about 10 nm. The mean grain size is measured in the same manner as in Example 1.

In that manner, herein produced is a color cathode ray tube of which the panel is coated with the three-layered surface film having selective light absorbability and having anti-reflective and antistatic capabilities.

In the color cathode ray tube of this Example, the first layer (that is, the lower layer directly contacted with the panel glass) of the surface film is so constructed that ATO (antimony-doped tin oxide) and yellow pigment therein are in substantial uniform dispersion. In addition, in the first layer, the refractive index of ATO is larger than that of the yellow pigment. In this, therefore, the refraction fluctuation peculiar to the pigment and occurring around the absorption zone is retarded to thereby attenuate the reflected color (body color) peculiar to the pigment. As a result, for its spectral reflection characteristic, the surface film-coated panel glass prepared herein gives a relatively flat spectral reflection pattern.

EXAMPLE 4

In this Example, neodymium oxide is added to a conventional panel glass paste to prepare panel glass. Concretely, the amount of neodymium oxide added to the paste is so controlled that the resulting panel glass could have a transmittance for eye photopic responsibility of 54%, and a transmittance of from 50% to 70% at the bottom of 570 nm absorption of neodymium oxide. The neodymium oxide content of the panel glass is measured through ICP analysis in the same manner as in Examples 1 to 3.

According to a known method, for example, described in Japanese Patent Laid-Open 64-7457 (this method comprises applying a dispersion as prepared by dispersing iron oxide red grains with a mean grain size of 20 nm in an aqueous slurry containing polyvinyl alcohol, surfactant, ammonium bichromate and the like, onto the back surface of panel glass to form a filter layer containing pigment grains with a mean grain size of from 5 nm to 70 nm and having a thickness of from 15 nm to 250 nm, between the panel glass and a phosphor film), microfilter layers are formed on the inner surface of the panel glass at the positions of the phosphors of blue (B) and red (R). In this step, the thickness of the microfilter layer to be formed at the position of the blue (B) phosphor is so controlled that the layer could have a transmittance for 450 nm wavelength light of 92% and a value of B.C.P. (brightness contrast performance—this is the index for indicating the contrast improvement) of 1.6. In addition, the thickness of the microfilter layer to be formed at the position of the red (R) phosphor is also controlled, like that of the microfilter layer formed at the position of the blue (B) phosphor, so that it could have a transmittance for 627 nm wavelength light of 92%, and a value of B.C.P. noted above of 1.2.

After this, phosphor films of R, B and G are formed in an conventional slurry method.

Next, the panel glass is washed, dried, and heated at 60° C., and thereafter sprayed twice with the liquid F of the composition 3 as prepared in Example 3 under the same condition as in Example 3. Then, this is dried, and thereafter further coated with the liquid B ad the liquid C in that order according to a spin-coating method, thereby forming a three-layered surface film on the panel glass.

Except for the step of coating the panel glass with the surface film as specifically indicated herein, the color cathode ray tube of this Example is constructed according to a conventional method.

Like that of Example 3, the color cathode ray tube of this Example also has selective light absorbability and antistatic and anti-reflective capabilities. In the color cathode ray tube of this Example, where the display screen is set at a color temperature of 6550K for white, the current ratio of red/blue, which is the largest in the current passing through the cathode in each electron gun for emitting three electron beams of R, G and B, could be at most 1.2 (in conventional color cathode ray tubes, the ratio falls between 1.8 and 2.0). The brightness of the white display plane of the color cathode ray tube of this Example is 22% higher than that of a comparative, conventional color cathode ray tube. The comparative, conventional color cathode ray tube tested herein differs from the color cathode ray tube of this Example in that, in the former, no neodymium oxide is added to the panel glass and the panel glass is coated with no surface film, but is the same as the latter in that the panels in the two have the same transmittance for eye photopic responsibility. In the comparative test, the blackness in the two is set at the same level.

EXAMPLE 5

In the color cathode ray tube of this Example, used is panel glass as prepared by adding neodymium oxide to a conventional panel glass paste.

After washed, the panel glass is heated at 80° C. at its outer surface, and then sprayed with the liquid F of the composition 3 having been prepared in Example 3. For the spray coating used is a Binks' spray-coater of Type A with two flow nozzles (flow rate:1.3 liters/hr, aeration:210 liters/min), and the surface of the panel glass is spaced by 180 mm from the spray-coater. The coated panel glass is then dried. The first layer having been formed on the outer surface of the panel glass under that condition has an average surface roughness of about 0.07 $\mu$m in the vertical direction relative to the its surface (that is, in the direction vertical to the surface of the panel glass) and a degree of swell of about 0.45 $\mu$m in the horizontal direction thereof (that is, in the direction parallel to the surface of the panel glass). The average surface roughness and the degree of swell as referred to herein are measured by the use of a scanning electron microscope equipped with an image processor (Hitachi's SEM Model S-2250 N, Model RD-500/550).

A second layer and a third layer are formed on the first layer by the use of a spin coater. Concretely, the panel glass coated with the first layer is further coated with the liquid B of the composition 3 in Example 3, according to a spin-coating method. For this, 40 ml of the liquid B is injected into the spin coater, and the panel glass is coated with it while being spun at 180 rpm over a period of 5 seconds. After dried at about 25° C., formed is the second layer. Next, this is still further coated with the liquid C of the composition 3 in Example 3 by the use of a spin coater into which 40 ml of the liquid C is injected, while being spun at 150 rpm over a period of 5 seconds. Thus is formed the third layer. After this, the thus-coated panel glass is baked at 160° C. for 30 minutes. In the surface film thus formed on the panel glass, the interfacial roughness between the first layer and the second layer in the direction vertical to the surface of the panel glass is on such a level that visible rays do not scatter at the interface, or that is, the distance between the adjacent hill and valley in the interface is from 1/10 to 1/6 of the shortest wavelength of visible rays.

In the interface between the first layer and the second layer in the surface film formed herein, light scatters in the horizontal direction. However, in this, the second layer having a high refractive index and a low transmittance can absorb the scattered light because of its specific film structure. In addition, in this, the interfacial roughness between the first layer and the second layer in the vertical direction is on such a level that visible rays to not scatter at the interface, or that is, the interface between the two layers has a specific fuzzy structure of such that the distance between the adjacent hill and valley in the interface is from 1/10 to 1/6 of the shortest wavelength of visible rays. For these reasons, the reflection spectrum of the surface film formed herein gives a relatively flat pattern. As a result, in the color cathode ray tube of this Example, the body color (reflected color) of the screen is attenuated, and the screen gives high-contrast display images while having antistatic and anti-reflective capabilities.

In the surface film, the second layer could be formed by spray-coating under the same condition as that for the first layer. In this case, the interface between the second layer thus formed by such spray-coating and the third layer could have the same fuzzy structure as above. Concretely, the interfacial roughness between the second layer and the third layer is on such a level that visible rays do not scatter at the interface, or that is, the distance between the adjacent hill and valley in the interface is from 1/10 to 1/6 of the shortest wavelength of visible rays. In this case, therefore, the body color (reflected color) of the screen could be much more attenuated.

EXAMPLE 6

For the color cathode ray tube of this Example, panel glass is prepared by adding neodymium oxide, along with erbium oxide or praseodymium oxide, to a conventional panel glass paste. For the light to be transmitted by the panel glass, its chromaticity values x, y in the CIE chromaticity diagram are controlled to fall within $0.280 \leqq x \leqq 0.290$ and $0.285 \leqq y \leqq 0.305$, by preferably x=0.285 and y=0.295. On the outer surface of the panel glass, formed is a surface film in the same manner as in any one of Examples 1 to 5.

The color cathode ray tube thus produced in this Example gives high-contrast display images, while having antistatic and anti-reflecting capabilities.

In Examples 1 to 6 mentioned hereinabove, dyes of organic compounds are incorporated into the surface films, which, however, are not limitative in the invention. Apart from such organic dyes, inorganic compounds are also employable in the invention, for example, as in the following Example.

EXAMPLE 7

Fine grains of inorganic compound pigments are used herein as the dyes to be incorporated into the surface film for the panel glass in Examples 2 to 6 mentioned above. As the inorganic compound pigments are in the form of fine grains, they are well compatible with the binder and also with silica ($SiO_2$) for forming the surface film. Therefore, the inorganic compound pigments are uniformly dispersed in the film formed through spraying or spin-coating, in the direction of the thickness of the film.

In this Example, the fine in organic pigment grains (having a mean grain size of at most 60 nm) may have any other finer pigment or dye grains adsorbed thereon. The coating grains shall have a smaller mean grain size than that of the base grains.

The inorganic compound pigments usable in this Example are as follows:

As the red pigment, for example, usable is $\alpha$-$Fe_2O_3$; as the green pigment, for example, usable is any of $TiO_2$, ZnO, CoO and NiO; and as the blue pigment, for example, usable is any of CoO and $Al_2O_3$.

In this Example, obtained are color cathode ray tubes capable of displaying high-contrast images while having antistatic and anti-reflective capabilities.

EXAMPLE 8

For the color cathode ray tube of this Example, neodymium oxide and erbium oxide are added to a conventional panel glass paste to prepare panel glass having a transmittance for eye photopic responsibility of about 60%. The panel glass is coated with a two-layered surface film having the composition 4 mentioned below. Except for the step of coating the panel glass with the surface film as specifically indicated herein, the color cathode ray tube of this Example is constructed according to a conventional method.

Composition 4:

| Coating liquid for forming the first layer (Liquid G): | |
|---|---|
| Fine silver grains | 0.2 wt. % |
| Fine palladium grains | 0.2 wt. % |
| Pure water | 45 wt. % |
| High-boiling-point solvent (ethylene glycol isopropyl ether) | 15 wt. % |
| Ethanol | balance |
| Coating liquid for forming the second layer (liquid H): | |
| Silicon ethoxide | 1.4 wt. % |
| Red pigment (quinoacridine-type pigment) | 0.1 wt. % |
| Blue pigment (phthalocyanine-type pigment) | 0.05 wt. % |
| Yellow pigment (disazo yellow) | 0.1 wt. % |

-continued

| Coating liquid for forming the first layer (Liquid G): | |
|---|---|
| High-boiling-point solvent (ethylene glycol monoethyl ether) | 10 wt. % |
| Ethanol | balance |

In this Example, the surface of the panel glass is coated with the liquids G and H in that order, according to any of the coating methods employed in Examples 1 to 5 mentioned above. In the surface film thus formed on the panel glass herein, the second layer, or that is, the upper layer contains the dyes.

Figure 5:
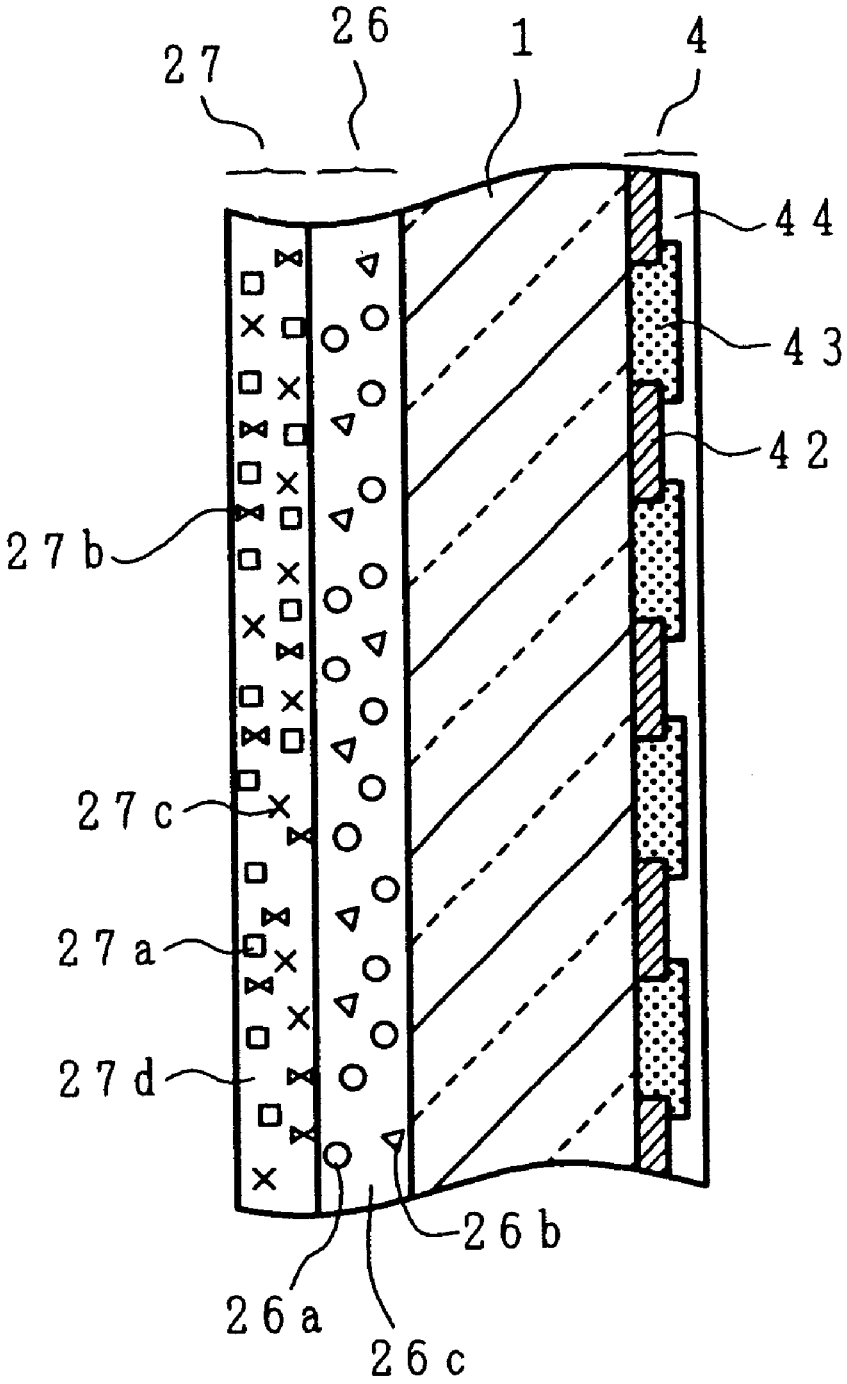
FIG. 5 is a schematic sectional view showing the principal structure of the panel of the color cathode ray tube as produced in Example 8 of the invention.
Figure 6:
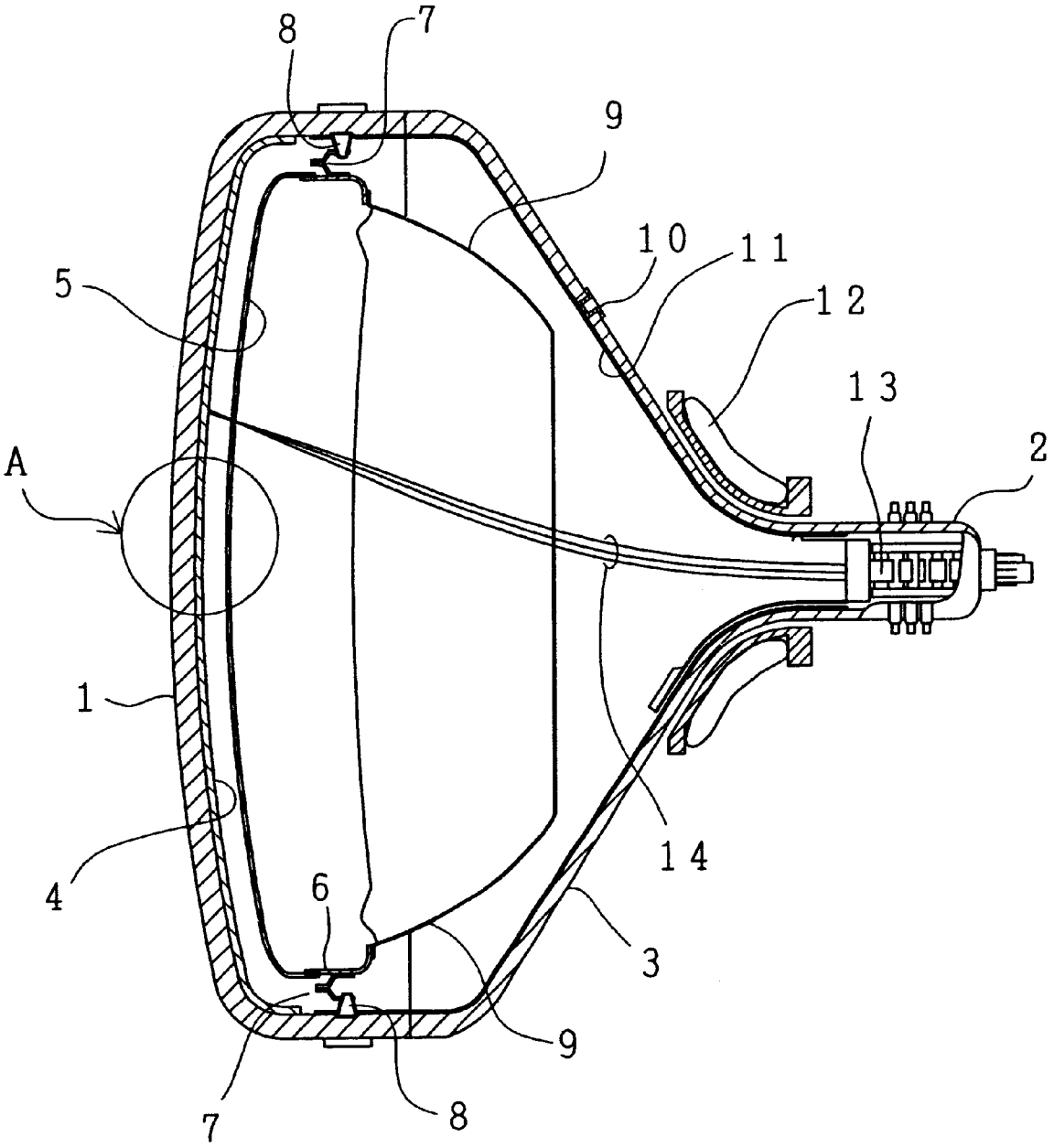
FIG. 6 (PRIOR ART)
FIG. 6 is a schematic sectional view showing an outline of the structure of a shadow mask-type color cathode ray tube, which is one example of cathode ray tubes.

FIG. 5 is a schematic sectional view showing the principal structure of the panel of the color cathode ray tube as produced in Example 8 of the invention. Like in FIG. 3, the panel glass 1 in FIG. 5 has, on its inner surface, phosphors 43 of three colors as partitioned via black matrices 42 each existing between them, and has a metal back 44 of aluminum as formed thereover through sputtering.

The surface film as formed on the outer surface of the panel glass 1 is composed of two layers. The first layer (lower layer) 26 of the surface film comprises fine silver grains 26*a*, fine palladium grains 26*b* and silica 26*c*; and the second layer (upper layer) 27 thereof comprises yellow pigment 27*a*, red pigment 27*b*, blue pigment 27*c* and 27*d*.

Like in the previous Examples, the color cathode ray tube produced in this Example give high-contrast and bright display images, while having selective light absorbability and antistatic and anti-reflective capabilities.

EXAMPLE 9

As in Example 1, the panel glass for the color cathode ray tube of this Example is prepared by adding from 0.005% to 1% by weight of neodymium oxide to a conventional panel glass paste. Except for the step of coating the panel glass with the surface film as specifically indicated herein, the color cathode ray tube of this Example is constructed according to a conventional method.

Composition 5:

Coating liquid for forming the first layer (Liquid A).

| Coating liquid for forming the second layer (Liquid I): | |
|---|---|
| Fine ITO grains | 3 wt. % |
| Pure water | 10 wt. % |
| Ethanol | 70 wt. % |
| Methanol | 10 wt. % |
| Diacetone alcohol | 7 wt. % |

Coating liquid for forming the third layer (Liquid C).

The fine grains of ITO (indium-doped tin oxide) used in this Example have a mean grain size of about 10 nm. The mean grain size is measured in the same manner as in Example 1.

In this Example, the surface of the panel glass is coated with the liquids A, I and C in that order, according to any of the coating methods employed in Example 1 to 5 mentioned above. In the three-layered surface film thus formed on the panel glass herein, the first layer contains the dye.

Like in the previous Examples, the color cathode ray tube produced in this Example gives high-contrast display images, while having selective light absorbability and antistatic and anti-reflective capabilities.

EXAMPLE 10

For the color cathode ray tube of this Example, used is neodymium ion-containing panel glass as prepared by adding neodymium oxide to a conventional panel glass paste. Except for the step of coating the panel glass with the surface film as specifically indicated herein, the color cathode ray tube of this Example is constructed according to a conventional method.

Composition 6

Coating liquid for forming the first layer (Liquid I).

Coating liquid for forming the second layer (Liquid C).

The surface of the panel glass with neodymium oxide added thereto is polished, then the abrasive used is removed, and the surface of the panel glass thus polished is cleaned by showering it with city water or pure water. Next, the panel glass is kept at about 60° C. at its surface, and then sprayed with the liquid I. For the spray coating, used is a Binks' spray-coater of Type A with two flow nozzles (flow rate:1.5 liters/hr, aeration:200 liters/min), and the surface of the panel glass is spaced by 180 mm from the spray-coater. The spray coating is repeated twice.

After having been coated with the liquid I, the panel glass is further coated with the liquid C. Concretely, the panel glass is kept at about 60° C. at its surface, and coated with the liquid C (this is prepared in Example 3) by the use of a spin coater. For this, 40 ml of the liquid C is injected into the spin coater, and the panel glass is coated with it while being spun at 150 rpm over a period of 5 seconds. After thus coated, the panel glass is dried at about 25° C., thereby having the second layer formed thereon.

The fine grains of ITO (indium-doped tin oxide) used herein have a mean grain size of about 10 nm. The mean grain size is measured in the same manner as in Example 1.

In that manner, herein produced is a color cathode ray tube of which the panel is coated with the two-layered surface film having selective light absorbability and having anti-reflective and antistatic capabilities.

In the color cathode ray tube of this Example, the first layer (that is, the lower layer directly contacted with the panel glass) of the surface film comprises fine grains of ITO (indium-doped tin oxide) and silica having been infiltrated thereinto from the second layer, and has a thickness of about 70 nm. In this, the second layer of the surface film is of silica, and has a thickness of from about 70 nm to about 90 nm.

The panel in this Example selectively absorbs light that falls within a wavelength range of from 500 nm to 550 nm, and light that falls within a wavelength range of from 550 nm to 600 nm. The surface film formed on the panel in this Example has a reflectance for eye photopic responsibility of 1.3% and a sheet resistivity of 9000 $\Omega/cm^2$.

EXAMPLE 11

For the color cathode ray tube of this Example, used is neodymium ion-containing panel glass as prepared by adding neodymium oxide to a conventional panel glass paste. Except for the step of coating the panel glass with the surface film as specifically indicated herein, the color cathode ray tube of this Example is constructed according to a conventional method. In this Example, first and second layers are formed on the outer surface of the panel glass in the same manner as in Example 10, except that the liquid B prepared in Example 1 is used in place of the liquid I in Example 10.

The panel in this Example selectively absorbs light that falls within a wavelength range of from 500 nm to 550 nm, and light that falls within a wavelength range of from 550 nm to 600 nm. The surface film formed on the panel in this Example has a reflectance for eye photopic responsibility of 1% and a sheet resistivity of 5000 $\Omega/cm^2$.

EXAMPLE 12

For the color cathode ray tube of this Example, used is neodymium ion-containing panel glass as prepared by adding neodymium oxide to a conventional panel glass paste. Except for the step of coating the panel glass with the surface film as specifically indicated herein, the color cathode ray tube of this Example is constructed according to a conventional method. In this Example, first and second layers are formed on the outer surface of the panel glass in the same manner as in Example 10, except that the following liquid J that contains fine grains of ATO (antimony-doped tin oxide) is used in place of the liquid I in Example 10.

Composition 7:

| Coating liquid for forming the first layer (liquid J): | |
|---|---|
| Fine ATO grains | 3 wt. % |
| Pure water | 10 wt. % |
| Ethanol | 70 wt. % |
| Methanol | 10 wt. % |
| Diacetone alcohol | 7 wt. % |

Coating liquid for forming the second layer (Liquid C).

The panel in this Example selectively absorbs light that falls within a wavelength range of from 500 nm to 550 nm, and light that falls within a wavelength range of from 550 nm to 600 nm. The surface film formed on the panel in this Example has a reflectance for eye photopic responsibility of 1% and a sheet resistivity of $5\times10^6$ $\Omega/cm^2$.

In the color cathode ray tubes produced in the previous Examples, the amount of the light-absorbing material to be in the surface film as formed on the panel is reduced to thereby attenuate the body color of the screen. Without their electroconductivity and anti-reflecting ability degraded, the selective light absorbability of the color cathode ray tubes is much enhanced. The color cathode ray tubes give high-contrast display images, while having good anti-reflective and antistatic capabilities.

While the invention has been described in detail and with reference to specific embodiments thereof, it will be apparent to one skilled in the art that various changes and modifications can be made therein without departing from the spirit and scope thereof.

What is claimed is:

1. A color cathode ray tube having a vacuum vessel that comprises a panel, a neck for housing an electron gun therein, and a funnel for connecting the panel and the neck, in which the inner surface of the panel glass is coated with a phosphor layer in different colors to give a display screen, wherein said panel glass has selective light absorption within a range of visible rays, and an outer surface of said panel glass is coated with an electrical conductive layer having selective light absorption within the range of visible rays, wherein the selective light absorption of said panel glass is larger than the selective light absorption of said electrical conductive layer.

2. The color cathode ray tube as claimed in claim 1, wherein light transmitted by said panel glass gives chromaticity values x and y, in the CIE chromaticity diagram, which fall within the following ranges:

$0.280 \leq x \leq 0.290$, and $0.285 \leq y \leq 0.305$.

3. A color cathode ray tube according to claim 1, wherein said electrical conductive layer comprises metal oxide grains or metal grains.

4. A color cathode ray tube according to claim 1, wherein said electrical conductive layer comprises grains of noble metal.

5. A color cathode ray tube according to claim 4 wherein said noble metal comprises silver or palladium.

6. A color cathode ray tube according to claim 1, wherein said panel glass contains a rare earth element or rare earth element ions.

7. A color cathode ray tube according to claim 1, wherein said panel glass contains neodymium or erbium.

8. A color cathode ray tube having a vacuum vessel that comprises a panel, a neck for housing an electron gun therein, and a funnel for connecting the panel and the neck, in which the inner surface of the panel glass is coated with a phosphor layer in different colors to give a display screen, wherein said panel glass has selective light absorption within a range of visible rays, and an outer surface of said panel glass is coated with plural layers comprising an electrical conductive layer and an electrical insulating layer, wherein said plural layers have selective light absorption within the range of visible rays, the selective light absorption of said panel glass being larger than a selective light absorption of said electrical conductive layer.

9. A color cathode ray tube according to claim 8, wherein said electrical insulating layer comprises a silica layer.

10. A color cathode ray tube according to claim 8, wherein said electrical insulating layer contains pigment.

11. A color cathode ray tube according to claim 8, wherein said plural layers includes a plurality of electrical insulating layers, at least one of said plurality of electrical insulating layers containing pigment.

12. A color cathode ray tube according to claim 8, wherein said electrical conductive layer contains pigment.

13. A color cathode ray tube according to claim 8, wherein said electrical conductive layer comprises grains of noble metal.

14. A color cathode ray tube according to claim 13, wherein said nobel metal comprises silver or palladium.

15. A color cathode ray tube having a vacuum vessel that comprises a panel, a neck for housing an electron gun therein, and a funnel for connecting the panel and the neck, in which the inner surface of the panel glass is coated with a phosphor layer in different colors to give a display screen, wherein said panel glass has selective light absorption within a range of visible rays in a range of wavelengths from 380 nm to 780 nm, and an outer surface of said panel glass is coated with plural layers comprising an electrical conductive layer and an electrical insulating layer, said plural layers have selective light absorption within the range of visible rays, and a light absorption of said panel glass is larger than a lights absorption of said plural layers.

16. A color cathode ray tube according to claim 15, wherein said electrical insulating layer contains pigment.

17. A color cathode ray tube according to claim 15, wherein said electrical conductive layer comprises grains of nobel metal.

18. A color cathode ray tube according to claim 17, wherein said noble metal comprises silver or palladium.

* * * * *